United States Patent [19]

Bostroem

[11] 4,173,663

[45] Nov. 6, 1979

[54] DIPLESS METALLIZING PROCESS AND APPARATUS

[76] Inventor: Theodore Bostroem, Park Rd. Ext., Middlebury, Conn. 06762

[21] Appl. No.: 705,351

[22] Filed: Jul. 14, 1976

Related U.S. Application Data

[63] Continuation of Ser. No. 482,886, Jun. 25, 1975, abandoned.

[51] Int. Cl.[2] ..... B05D 1/02; B05D 1/28; B05D 1/40

[52] U.S. Cl. ..... 427/211; 427/209; 427/318; 427/321; 427/346; 427/349; 427/337; 427/360; 427/398 D; 427/399; 427/422; 427/424; 427/427; 427/428

[58] Field of Search ..... 427/398 D, 421, 209, 427/211, 321, 318, 345, 349, 367, 399, 428, 424, 427, 357, 422, 360; 118/405, 122, 325, 235, 255, 207, 316

[56] References Cited

U.S. PATENT DOCUMENTS

| | | | |
|---|---|---|---|
| 287,076 | 10/1883 | Young | 427/398 |
| 1,981,130 | 11/1934 | Underwood | 427/398 |
| 2,322,787 | 6/1943 | Brennan | 427/422 |
| 2,701,775 | 2/1955 | Brennan | 427/422 |
| 2,937,108 | 5/1960 | Toye | 427/319 |
| 2,972,185 | 2/1961 | Brennan | 427/422 |
| 3,086,879 | 4/1963 | Lassiter | 427/422 |
| 3,383,189 | 5/1968 | Sendzimir | 427/357 |
| 3,782,909 | 1/1974 | Cleary et al. | 427/357 |
| 3,809,570 | 5/1974 | Herman | 427/374 |
| 3,881,040 | 4/1975 | Patterson | 427/357 |
| 3,941,906 | 3/1976 | Bostroem | 427/360 |

*Primary Examiner*—Michael F. Esposito
*Assistant Examiner*—Janyce A. Bell
*Attorney, Agent, or Firm*—Donald D. Jeffery

[57] ABSTRACT

Metallic articles, for instance, ferrous strips are metallized, for instance, zinc coated by passing the heated article through a coating chamber and applying thereto a continuous stream of the molten coating metal so as to uniformly and evenly metallize said article. Thereafter, excess molten coating metal is removed from the coated article by hot gas blasting and the hot gas blasted article leaving the coating chamber is immediately cooled. Wiping means may be provided before applying the molten coating metal so as to deflect any molten coating metal dropping from the metallic article passing therethrough, while rollers may be arranged between the coating metal applying means and the hot gas blasting means. Said rollers serve to remove the major part of excess coating metal from the coated metallic article and to stabilize movement of the metallic article passing through the coating chamber. In contrast to known application of coating metal by atomizing or spraying, no gas is admixed to the continous stream of the molten coating metal which is, so to say, gently poured onto the surface of the metallic article. Thus coating is effected within a short period of time and a non-porous coating is achieved.

11 Claims, 7 Drawing Figures

DIPLESS METALLIZING PROCESS AND APPARATUS

This is a continuation of application Ser. No. 482,886, filed June 25, 1975, now abandoned.

BACKGROUND OF THE INVENTION

1. Field of the Invention

The present invention relates to an improved process of providing a metallic article such as a ferrous strip with a coating such as a zinc coating and more particularly to a "dipless" metallizing process without dipping the article into a molten metallizing bath and to an apparatus for carrying out said process.

2. Description of the Prior Art

Modern galvanizing procedures, in spite of recent improvements, can still be considered an outdated inheritance of the original hot dip galvanizing in which the article to be coated was submerged, while still cold, in a heated zinc pot, thereby passing through a layer of a flux which floats on the molten zinc bath and cleans the article to be coated of any dirt and moisture.

Before galvanizing takes place, the article had to be heated to about the melting point of the zinc. Such heating, of course, takes some time. During heating a brittle layer of a ferro-zinc alloy was formed on the interface between the article and the zinc layer. Said ferro-zinc alloy layer caused the zinc coating to readily flake and peel off the article, thus diminishing considerably the anti-corrosive properties of the galvanized article.

In spite of vast improvements as they are achieved by recent modifications of the known processes, the sheet material, usually in the form of a continuous strip, is still passed through a molten zinc bath after it has been preheated and under the protection of a non-oxidizing atmosphere. Thus, it is no more necessary to keep the strip in the molten zinc in order to heat it. However, on account of merely geometrical considerations, the strip must remain in contact with the molten zinc for a longer period of time than required for purely metallurgical consideration. As a result of such a prolonged contact of strip and zinc a brittle ferro-zinc alloy of greater thickness than desired is formed. Formation of the ferro-zinc alloy is prevented, at least partly, by the addition of aluminum or the like to the zinc bath. Such addition, however, reduces to some extent the ductility of the zinc coating in comparison to the ductility of a non-alloyed zinc coating.

It follows that the duration of contact between the article and the zinc bath is determined by the use of a zinc bath provided with a sinking drum as well as by the dimensions of such a drum.

SUMMARY OF THE INVENTION

It is one object of the present invention to overcome the disadvantages of the heretofore used hot dip galvanizing or other metallizing process and to provide a dipless process whereby contact of the ferrous article with the zinc is of such a short duration that formation of the ferro-zinc alloy layer can be kept under control without having to add aluminum to the spelter.

Another object of the present invention is to provide a simple and effective apparatus to carry out said dipless galvanizing or metallizing process.

A further object of the present invention is to provide a pure zinc coated ferrous strip or article with an intermediate ferro-zinc alloy layer of optimum minimum thickness.

Other objects of the present invention and advantageous features thereof will become apparent as the description proceeds.

In principle the process according to the present invention comprises instantaneous application of molten metal, i.e. fluid zinc to the heated article, i.e. the hot strip, followed immediately thereafter by exposing the zinc coated article or strip to the action of a hot, non-oxidizing gas blast which removes excess zinc and limits the thickness of the zinc coating. Preferably immediately thereafter the zinc-coated article or strip is rapidly cooled to a temperature below the melting point of the zinc by exposing it to the action of a cooling blast, for instance, by means of jets of a cooling fluid.

According to another embodiment of the present invention a pair of rollers is provided between the application of molten zinc to the article and the hot gas blast. These rollers effect better distribution and spreading of the zinc across the entire width of the strip; they will exclude any effect of the hot gas blast on the apparatus and arrangements for applying the zinc to the strip; they will cause considerable stabilization of the moving strip thus resulting in greater efficiency of the hot gas blast arrangements.

The possible geometry of such a process limits the length of contact between ferrous article and zinc to a few inches, compared to several feet as is the case for processes using a zinc bath and a sinking drum. Thus the duration of the iron-zinc contact according to the present invention is several times shorter than that of the conventional methods. In fact the duration of zinc to-article contact is limited to less than a second.

As a result thereof, non-alloyed zinc can be used in the process of the present invention thus improving the corrosion resistance of the zinc coating ("pure" metal coating) without undue growth of the brittle intermediate ferro-zinc alloy layer, thus ensuring excellent adherence of the pure zinc coating to the coated article or strip.

Several, but by no means limiting, ways of applying zinc to the strip can be employed. For instance, molten zinc can be poured onto the strip from headers equipped with appropriate nozzles through which molten zinc is discharged upon the strip, for instance, immediately before it is passed between the above mentioned rollers. According to another embodiment of the present invention, the molten zinc is applied to the bodies of the rollers and then applied ("printed") onto the strip as it contacts said rollers. As mentioned above the strip emerging from said rollers undergoes a hot non-oxidizing gas blast followed by a rapidly cooling blast outside of the coating chamber. This blast does not have to be non-oxidizing. An air blast or a water spray or the like are adequate means for cooling the coated article.

In a preferred, but by no means limiting, embodiment of the present invention, the strip emerging from a "snout" of a pretreating device, such as a continuous furnace, is conducted around a pulley and rises to the zone of the metallizing process in a substantially vertical direction. The atmosphere surrounding the pulley is substantially the same as is used in the pretreating furnace.

The process chamber has an entry slot for the strip by which it enters said chamber from the box which carries the strip deflecting pulley. The strip is then taken through "reversed" wiper means contacting the strip under a very slight pressure. The purpose of these wiper means is to prevent any excess zinc rolled off the strip by rollers arranged after the wiper means, from falling down onto the strip deflecting pulley. The major part of the zinc removed from the stip by the rollers will run down onto the top faces of the wiper means. If part of the zinc runs through the slot of the wiper means, it will, by capillary action, run down the bottom face of the wiper means. As a result thereof, the rolled-off zinc will drop to the bottom of the process chamber from where it is returned to the zinc melting and de-oxidizing oven.

The molten zinc is supplied to the zinc application device from a zinc melting oven by means of a zinc pump. Excess molten zinc which is partly removed by the rollers and finally by subsequent hot blasting, drops to the bottom of the process chamber, from where it is returned, by gravity, to the zinc melting oven for further recirculation. Should any zinc oxide have been formed on the way from the process chamber, it will be de-oxidized to metallic zinc by the floating layer of de-oxidizing agent provided on the molten zinc surface of the oven.

The zinc applying means are provided between the reversed wiper means and the rollers which serve to remove most of the excess zinc from the coated strip. Thereafter, the zinc coated strip is subjected to a hot blast of a non-oxidizing gas which removes the remainder of the excess zinc. The coated strip passes then from the coating chamber through a narrow slot into the surrounding atmosphere, where it undergoes rapid cooling, i.e. quenching.

The combination of said guiding rollers and the immediate quenching of the strip coating at the strip exit from the chamber permits to considerably reduce the non-guided portion of the coated strip, rendering it substantially rigid, when it arrives at the hot blasting zone. Said guiding distance is measured vertically from the bite of said rollers and up to the point where, after being spray cooled, the zinc coating has become sufficiently hard to be mechanically guided by a pulley. Thereby, the strip is kept in a substantially rigid condition so as to ensure optimum performance of the hot blast. As a result thereof, the nozzles (or the slot) of the hot blasting unit can be placed much nearer to the strip surface than is possible without the use of the rollers and the rapid cooling means. This fact, in its turn, will result in a lower hot gas pressure and a lower gas consumption.

The resulting "stability" of the travelling strip in the coating chamber also permits to provide narrowing of the strip exit slot therefrom. A narrow exit slot, of course, allows to operate under a lower pressure of the non-oxidizing atmosphere in the coating chamber than heretofore possible. As a result thereof, the gas consumption of the galvanizing unit is considerably reduced.

The short exposure of the metal of the strip to the molten zinc and the almost immediate cooling of the zinc coating which takes place when the strip exits from the coating chamber render it possible to reduce considerably or to even completely eliminate the addition of aluminum to the spelter.

When aluminum is added to the spelter, the hot blast must be of a non-oxidizing composition or it must even be, for practical reasons, slightly deoxidizing so as not to cause oxidation of the added aluminum. However, when proceeding according to the present invention, the time of contact of the molten zinc with the strip is so short that addition of aluminum can be completely avoided. Therefore, superheated steam can be used for hot blasting because it does not oxidize molten zinc. Such superheated steam is much cheaper and simpler to produce than a non-oxidizing gas blast. Besides, should air be mixed with the steam and should some zinc oxide be formed, the de-oxidizing effect of the protective layer provided on the zinc surface in the zinc melting oven will reduce any formed oxide to metallic zinc. It is, of course, not possible to reduce the aluminum oxide portion of conventional top-dross by the de-oxidizing layer in the zinc melting oven.

In view of the fact that the coating of the metallic article can consist of pure zinc when proceeding according to the continuous hot coating process of the present invention, the resulting coating has the best imaginable anti-corrosive properties. Since the coating consists of pure metal, no galvanic effects between the basic zinc and its alloying elements are encountered.

Another advantage of the process according to the present invention is that the coating of pure zinc is more flexible and ductile than that of its alloys, including aluminum-zinc alloys. Thus the pure zinc coated strip can better be subjected to stamping and/or drawing working than products galvanized in the conventional manner.

While the process according to the present invention has been described hereinabove with respect to galvanizing ferrous articles such as steel strips, it is, of course, also possible to use said process for applying coatings of other metals to metallic articles. Thus the process can be used, for instance, for coating articles and especially strip with aluminum, tin or tern alloy, or others. Of course, other metallic articles than ferrous articles such as copper strips can also be metallized by the process of the present invention.

Likewise, instead of pouring the molten metal through nozzles upon the metallic article or strip or applying it to the article or strip by means, for instance, it can also be applied thereto by other means, for instance, by forcing a stream of molten zinc by gravity upon the strip or by any other suitable means. In principle, the molten coating metal is applied to the metallic article by projecting or gently pouring it thereon in the form of a continuous stream.

BRIEF DESCRIPTION OF THE DRAWINGS

The above and other objects, advantages, and uses of the present invention will become apparent from a reading of the following specification and claims taken in connection with the attached drawings which form a part of the specification and wherein

Like numerals in said drawings indicate like parts of the equipment.

DESCRIPTION OF THE PREFERRED EMBODIMENTS

Figure 1:
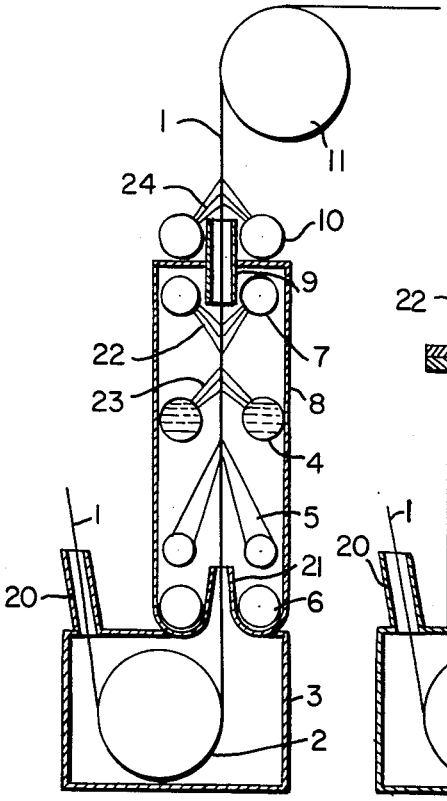
FIG. 1 is a vertical cross-sectional view of a dipless coating apparatus in which molten zinc is applied to the rising strip which is then hot-blasted and quenched.

In said drawings, FIG. 1 demonstrates the principal features of the present invention.

In said FIG. 1 strip 1 to be coated is passed from the pretreating furnace (not shown) through snout 20 into substantially gas-tight chamber 3 carrying strip deflecting pulley 2. Said pulley 2 deflects strip 1 so that it is conducted vertically upwardly into coating and processing chamber 8 containing and enclosing the various elements of the galvanizing process of the present invention. Strip 1 passes through orifice-like opening 21 into said chamber 8 and is then contacted by the pair of wipers 5. Strip 1 is then contacted by a continuous stream of molten zinc 23 dispensed through headers 4 with nozzle-like openings. Excess zinc drops onto wipers 5 and is deflected from the strip and collected in return conduit 6 from which the zinc is returned into the zinc melting and regenerating oven (not shown). The remainder of excess zinc on the zinc coated strip is removed therefrom by the hot gas blast 22 supplied through hot gas blast header 7. The zinc-coated strip 1 from which excess zinc has been removed passes through strip exit slot 9 of coating chamber 8 and is conducted to stabilizing pulley 11 which in co-operation with strip deflecting pulley 2 stabilizes movement of the strip on travelling through coating chamber 8. Immediately after coated strip 1 has left said chamber 8 through exit slot 9, it is rapidly cooled by exposure to a spray of a cooling fluid 24 sprayed thereon by means of header 10. When operating as shown in FIG. 1, the strip is passed successively through reverse wipers 5, a stream of molten zinc 23 applied by means of header 4 and hot gas blast 22 applied by means of header 7, all of them enclosed in processing chamber 8, and is then rapidly cooled by cooling fluid spray 24.

Figure 2:
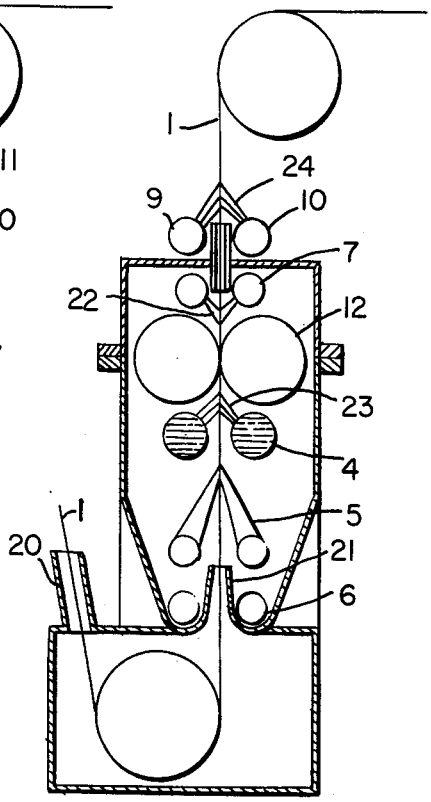
FIG. 2 is a cross-sectional view of a similar dipless coating apparatus in which strip movement stabilizing and excess zinc removing rollers are provided between the zinc applying means and the hot-blasting means.

The coating apparatus as illustrated in FIG. 2 differs from that of FIG. 1 by providing between the application of the molten zinc stream 23 and the hot gas blast 22, roller means 12 which remove the major part of excess zinc from coated strip 1 passing therethrough. Said roller means 12 aid in further stabilizing the movement of strip 1 on its travel through coating chamber 8.

Figure 3:
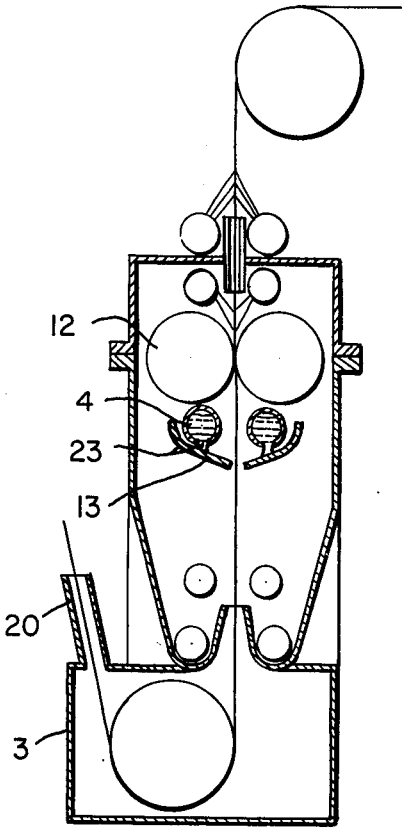
FIG. 3 is a cross-sectional view of a similar dipless coating apparatus in which the molten zinc is applied to the strip by means of a trough-like distributing means.

In FIG. 3 a modification of the means for applying a continuous stream of molten zinc to strip 1 is illustrated while otherwise the apparatus is the same as shown in FIG. 2. According to this modification the molten zinc 23 is poured from header 4 onto deflecting and distributing spreader 13 which applies it to strip 1.

Figure 4:
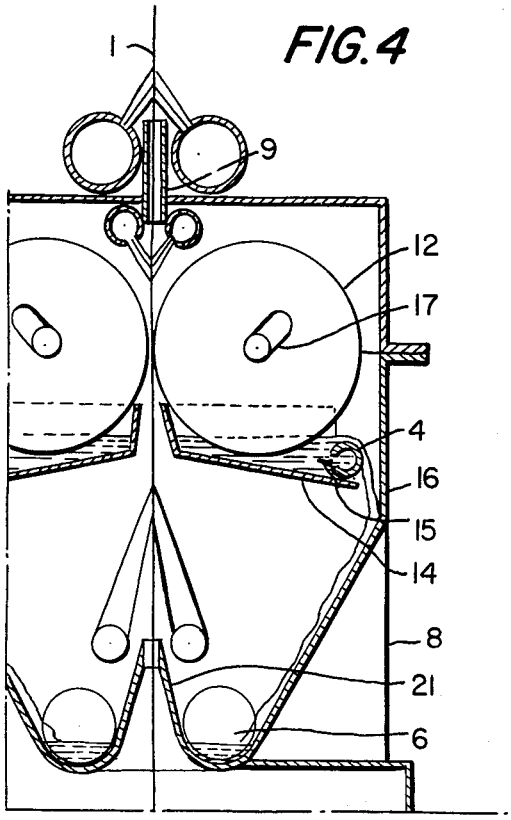
FIG. 4 is a cross-sectional view of a dipless coating apparatus in which the molten zinc is applied to the strip by means of the stabilizing rollers which are partly immersed in an overflowing dipping bath.

Another means of applying the molten zinc to strip 1 is illustrated in FIG. 4. According to said modification the molten zinc 15 is supplied to pans 14 by means of header 4. Rollers 12, as shown, dip into said pans 14 and carry along the molten zinc for application to strip 1. The rollers 12 are provided with elongated and inclined slots 17 which carry a journal of the stabilizing rollers 12 and thus assist in exerting pressure between the rollers 12 but still permit to readily shift the rollers so that a strip threading tool can be passed therebetween. Dipping pans 14 are provided with a molten zinc overflow 16 allowing the molten zinc 15 in the pans 14 to overflow onto and along the walls of coating chamber 8 and downwardly into the return conduit 6 from where it is returned to the zinc melting oven (not shown).

Figure 5:
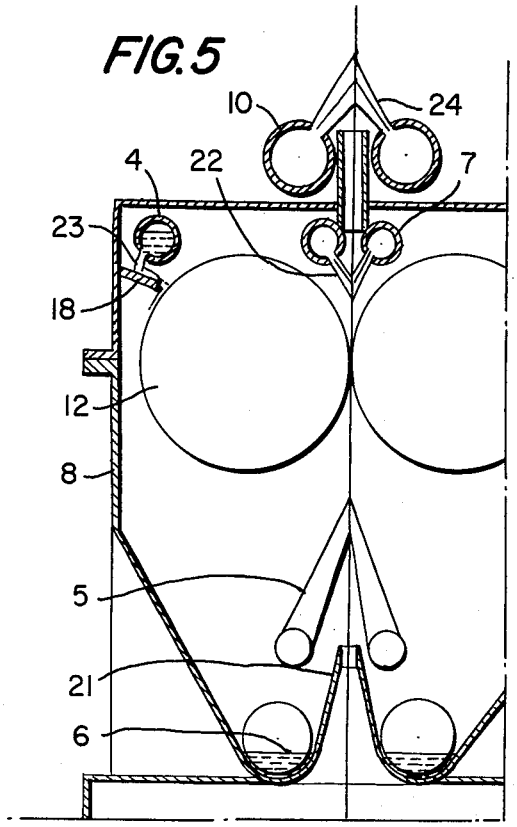
FIG. 5 is a cross-sectional view of a dipless coating apparatus similar to the apparatus of FIG. 4 in which the molten zinc is poured on the rollers from a header and is applied to the strip by said rollers covered with the molten zinc.

Another modification of the means for applying molten zinc to the strip 1 is illustrated in FIG. 5, whereby the molten zinc stream 23 is supplied through header 4 to deflector-distributor plate 18 which allows to evenly spread the molten zinc over the surfaces of rollers 12 which apply ("print") the molten zinc onto the surface of strip 1.

It will be noted that in the apparatus illustrated by FIGS. 2 to 5 inclusive in which strip stabilizing rollers 12 are used, the exit slots 9 can be made much more narrower than in the apparatus illustrated by FIG. 1, where no stabilizing rollers are used. Since movement of the strip is greatly enhanced by providing rollers 12 as shown in FIGS. 2 to 5, the efficiency of the hot blast is considerably improved, so that a reduced hot blast gas consumption is achieved. Consequently, the hot gas blast headers 7 can be made smaller than the headers 7 of FIG. 1, which shows no stabilizing rollers.

As stated above, the claimed process permits, according to another embodiment of the present invention, to conduct the hot metallic article to pass substantially horizontally through coating chamber 3. Thus the procedure permits to eliminate the wiper means described hereinabove.

Figure 6:
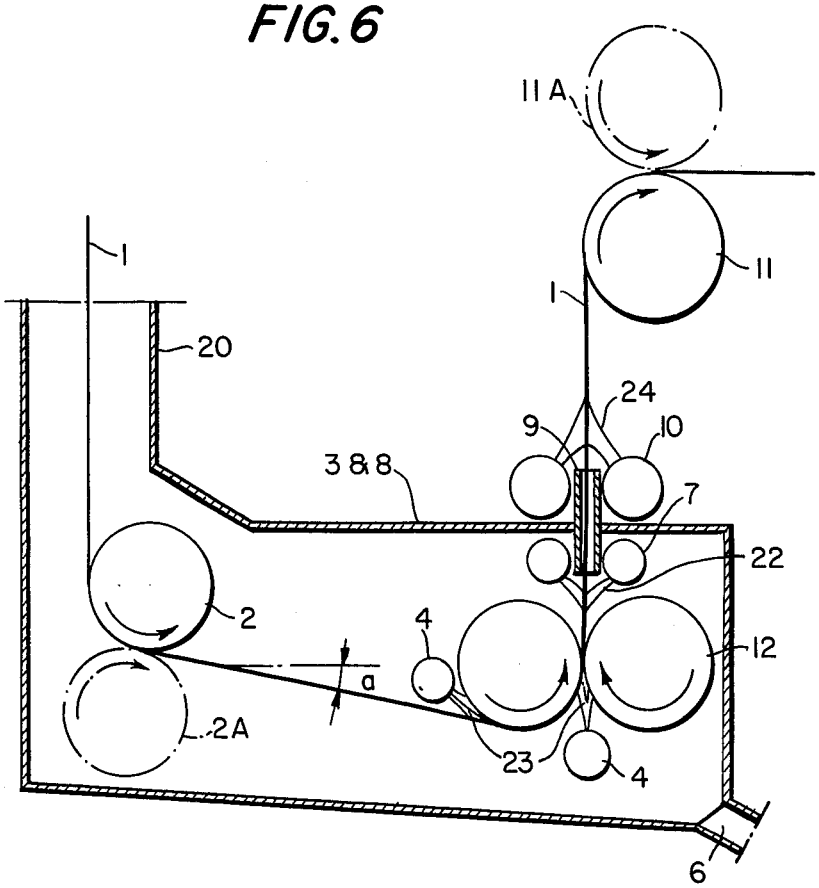
FIG. 6 is a cross-sectional view of a dipless coating apparatus in which the strip is passed through the coating chamber in substantially horizontal direction and, after coating, is deflected upwardly for subsequent treatment.

FIG. 6 illustrates in cross-sectional view this procedure. In said Fig. strip 1 to be coated is passed from the pretreating furnace into chamber 3 which carries the strip deflecting pulleys 2 and 2*a*. Pulley 2*a* may even be omitted. Strip 1 passes then substantially horizontally preferably at a small angle downwardly, toward rollers 12 which remove the major part of excess zinc from coated strip 1. Said rollers preferably deflect the coated strip upwardly to the hot blast means.

While passing from deflecting pulleys 2 and 2*a* through coating chamber 3, the strip is contacted by a continuous stream of molten zinc 23 dispensed through headers 4 with nozzle-like openings. Preferably the upper header is provided in the substantially horizontal part of the strip while the lower header is provided underneath rollers 12. Otherwise the procedure is the same as described hereinabove, except that the wiper or deflecting means 5 are omitted.

Figure 7:
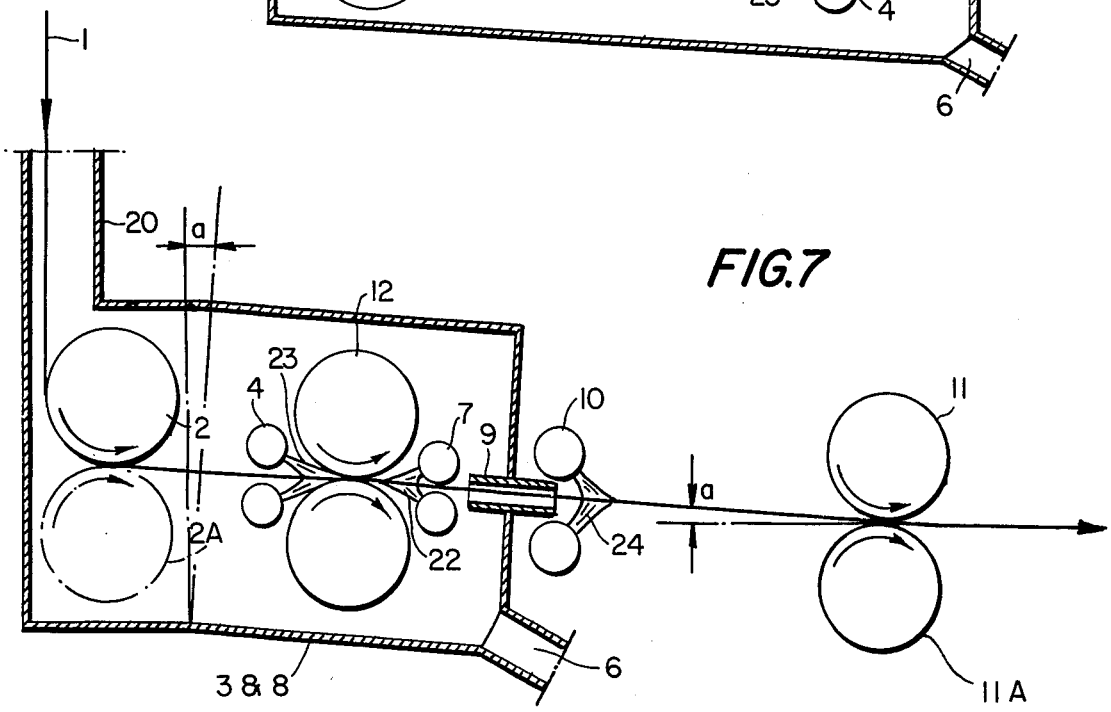
FIG. 7 is a cross-sectional view of a dipless coating apparatus similar to that of FIG. 6 in which the strip is passed substantially horizontally through the coating chamber and also through the subsequent treatment systems.

FIG. 7 illustrates a further embodiment of the present invention whereby the strip after coating is horizontally conveyed past the hot gas blast header 7 through strip exit slot 9 of coating chamber 3 to stabilizing pulleys 11 and 11*a*. Between exit slot 9 and stabilizing pulleys 11 and 11*a* there are arranged two headers 24 spraying cooling fluid upon the coated strip 1 so as to rapidly cool the same.

Coating chambers 3 in FIGS. 6 and 7 are provided with outlet 6 for excess molten coating metal. The angle of downward inclination of strip 1 traveling through coating chamber 3 is indicated by a.

I claim:

1. In a process of providing a metallic article in strip form with a metallic coating, the steps which comprise (a) passing the metallic strip preheated to coating temperature in a substantially vertical direction through a processing chamber;

(b) passing the metallic strip through a coating zone and applying by distributing means a continuous stream of the molten coating metal uniformly to both sides of the metallic strip for a short period of time so as to minimize the formation of an intermediate alloy layer between the coating metal layer and the surface of the metallic article;

(c) conducting excess molten coating away from the metallic strip by deflecting any excess coating running downwardly from the article strip, whereby the coating can be recovered and does not interfere with the conveying of successive portions of the strip to the coating zone, and (d) subjecting the coated metallic strip to the action of a hot, non-oxidizing gas blast subsequent to said coating application so as to remove any remaining excess coating metal from the coated metallic article.

2. The process of claim 1 further including the additional step of, immediately after hot gas blasting, rapidly cooling the coated article by the action of a cooling blast.

3. The process of claim 1 further including the step of passing the coated article through means effecting distribution and spreading of the coating metal across the entire surface of the coated metallic article thereby removing the major part of excess coating metal from the coated article and guiding and stabilizing the metallic article on its passing through the coating zone, said distributing and spreading means being arranged between the means for applying the coating metal to the metallic article and the hot gas blast.

4. The process of claim 1, further including the step of continuously applying coating metal to the metallic article by means of nozzles adapted to projecting a continuous stream of coating metal onto the hot metallic article.

5. The process of claim 1, in which the molten coating metal is continuously applied to the metallic article by means of roller means adapted to apply a continuous layer of coating metal onto the hot metallic article.

6. The process of claim 1, in which the coating metal is zinc and the metallic article to be coated is a ferrous article.

7. In a process of providing a metallic article in strip form with a metallic coating, the steps which comprise (a) passing the metallic strip preheated to coating temperature through a processing chamber, with the strip being inclined slightly downwardly with respect to horizontal;

(b) passing the metallic strip through a coating zone and applying by distributing headers a continuous stream of the molten coating metal directly and uniformly to both sides of the metallic strip for a short period of time, without dipping the strip into a molten bath, so as to minimize the formation of an intermediate alloy layer between the coating metal layer and the surface of the metallic article;

(c) conducting excess molten coating away from the metallic strip by means of rollers between which the coated strip passes, said rollers removing the major part of the excess coating from the strip whereby the coating can be recovered and does not interfere with the conveying of successive portions of the strip to the coating zone, and (d) subjecting the coated strip to the action of a hot, non-oxidizing gas blast above said rollers, so as to remove any remaining excess coating metal from the coated strip.

8. In a process of providing a metallic article in strip form with a metallic coating, the steps which comprise (a) passing the metallic strip preheated to coating temperature in a substantially vertical direction through a processing chamber;

(b) passing the metallic strip through a coating zone in said processing chamber and applying a continuous stream of the molten coating metal directly and uniformly to both sides of the metallic strip for a period of time of less than 1 second, without dipping the strip into a molten bath, so as to reduce formation of an intermediate alloy layer between the coating metal layer and the surface of the metallic article.

(c) subsequently passing the coated strip through roller means in said processing chamber effecting distribution and spreading of the coating metal across the entire surface of both sides of the coated strip, thereby removing the major part of excess coating metal from the coated strip while simultaneously guiding and stabilizing the coated strip on its passing through the coating zone, and (d) subjecting the coated metallic strip to the action of a hot, non-oxidizing gas blast so as to remove any remaining excess coating metal from the coated metallic article.

9. The process of claim 7 in which said molten coating is applied to both sides of the strip in less than 1 second.

10. The process of claim 7 in which the molten coating metal is applied to said metallic strip by means of rollers.

11. The process of claim 8 in which the molten coating metal is applied to said metallic strip by means of rollers.

* * * * *